United States Patent [19]

Phillips

[11] 4,342,979

[45] Aug. 3, 1982

[54] LIGHTED CIRCUIT BREAKER

[75] Inventor: Ernest L. Phillips, Denver, Colo.

[73] Assignee: Jet Accessories, Inc., Denver, Colo.

[21] Appl. No.: 168,016

[22] Filed: Jul. 14, 1980

[51] Int. Cl.[3] ..... H01H 73/14

[52] U.S. Cl. ..... 337/41; 337/66; 337/79

[58] Field of Search ..... 337/41, 75, 79, 86, 337/417, 66, 376, 46; 340/664; 200/314

[56] References Cited

U.S. PATENT DOCUMENTS

| | | | |
|---|---|---|---|
| 2,439,338 | 4/1948 | Fuge et al. | 337/79 |
| 2,780,801 | 2/1957 | Tyler | 200/314 |
| 3,169,239 | 2/1965 | Lacey | 337/113 |
| 3,356,816 | 12/1967 | Clarke | 337/79 |

FOREIGN PATENT DOCUMENTS

| | | | |
|---|---|---|---|
| 1191030 | 4/1965 | Fed. Rep. of Germany | 337/66 |

*Primary Examiner*—William H. Beha, Jr.

[57] ABSTRACT

A circuit breaker is provided of the push-pull type for use in the cockpit of an aircraft wherein the plunger of the circuit breaker is illuminated upon the opening of a circuit. The illumination immediately attracts the pilot's attention so that corrective action can be taken. A bimetallic strip bows when it is heated due to overloading of the circuit causing the plunger to be extended and to complete a secondary circuit to a light located within the head of the plunger. A number of the circuit breakers are electrically interconnected to provide a visual indication to the pilot that a fault condition has occurred in one of the monitored aircraft circuits. In addition, an indicator is available to inform the pilot that a second fault condition has occurred subsequent to the occurrence of a first fault condition while the first fault condition remains.

3 Claims, 11 Drawing Figures

LIGHTED CIRCUIT BREAKER

DESCRIPTION

1. Technical Field

This invention relates to the field of circuit breakers which have an illumination means that is energized upon overloading of the circuit, and more particularly to such a circuit breaker for use on the control panel of an aircraft.

2. Background Art

For many years, it has been common in aircraft to provide circuit breakers for at least all critical circuits in an aircraft which will be opened when an overload condition is sensed. Typically, these circuit breakers are mounted in an array on a control panel in the cockpit of the aircraft. The most common circuit breaker is the push-pull type which has a bi-metal strip normally connected across the load of the circuit. When the circuit becomes overloaded, the bi-metal strip bows or bends until a plunger on the circuit breaker is released and the bi-metal strip moves to an open position. Typically, the control panel of an aircraft and the circuit breakers are painted with a non-reflective black paint and the head or end of the plunger of the circuit breaker is painted a bright contrasting color, such as orange or white. Often, the neck or throat of the plunger is also painted with this contrasting color so that when a circuit breaker is open, the pilot or other personnel in the cockpit will see it as soon as possible so that appropriate corrective action can be taken.

Of course, the pilot or other cockpit personnel must observe the open circuit breaker by means of ambient light in the cockpit or by means of artificial illumination at night. In larger, more complex aircraft, the number of circuit breakers on the control panel may be in the hundreds, making it very difficult for cockpit personnel to immediately identify an open circuit and in fact, if the malfunction is not readily apparent from the performance of the aircraft, the pilot might not ever become aware of the malfunction. Should the broken circuit be to equipment whose operation is critical to the safe flying of the aircraft, the results can be disastrous. For example, if the open circuit is to a gyroscope and its malfunction is not discovered before the gyroscope spins down, the aircraft could crash because corrective action was not taken. Various lighted circuit breakers, i.e., circuit breakers which have illumination means which are energized upon the breaking of the main circuit, have been developed. Examples of these are disclosed in U.S. Pat. No. 2,059,985 to Frank et al; U.S. Pat. No. 3,169,239 to Lacey et al; and U.S. Pat. No. 4,056,816 to Guim. However, the Frank et al and Guim patents are directed to a toggle type circuit breaker which has no similarity to the push-pull circuit breaker used in aircraft, as referred to above. The Lacey et al patent relates to a circuit breaker which forms part of an electrical receptacle so that if the receptacle is overloaded, the circuit is broken. Again, this structure is not relevant to the push-pull type circuit breakers used on the control panels of aircraft.

DISCLOSURE OF INVENTION

In accordance with this invention, an illuminated push-pull circuit breaker is provided for use on the control panel of an aircraft wherein the circuit breaker becomes illuminated upon the opening of a circuit so that the pilot or other cockpit personnel is immediately made aware of the malfunction and can take correction action.

More particularly, a push-pull circuit breaker is provided wherein a light source is located within the head and/or shaft of the plunger which is illuminated when the bi-metal strip becomes bowed due to overloading of the circuit. This bowing of the bi-metal strip causes a locking means which holds the plunger in retracted condition to be released so that the plunger is urged outwardly to a position wherein a secondary circuit to the light source is completed and the primary circuit is opened.

Specifically, the plunger has electrical leads running from the lamp or illuminating means down through the side of a sleeve at the other end of the plunger to an electrical contact near the inner end of the sleeve. Through a ball and cam arrangement within the sleeve and the presence of an internal spring in the sleeve, the plunger is normally held in circuit closing position wherein the bi-metal strip extends across permanent contacts located in the housing of the circuit breaker. The plunger is held in this position against the force of a plunger-extending spring. However, upon overheating of the bi-metal strip due to an overload in the main circuit, the strip will bend releasing the locking means so that the plunger-extending spring forces the plunger outwardly whereupon the contacts on the sleeve of the plunger engage contacts in the housing closing the circuit to the light in the plunger which now protrudes beyond the instrument panel and is illuminated. Thus, the open circuit can more quickly and easily be identified by the pilot or other cockpit personnel due to improved visibility of the circuit breaker.

Circuit breakers constructed in accordance with this invention may be connected to a Master Caution and/or an Annunciator panel as a further means of assuring pilot attention to a circuit overload in one or more of the aircraft circuits.

Additional advantages of this invention will become apparent from the description which follows, taken in conjunction with the accompanying drawings.

BEST MODE FOR CARRYING OUT THE INVENTION

Figure 1:
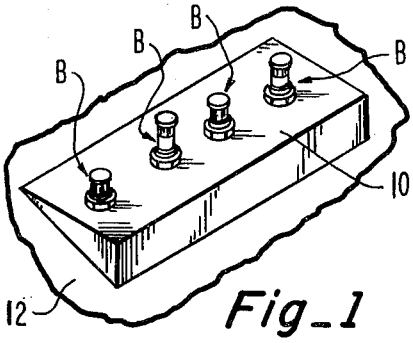
FIG. 1 is a fragmentary perspective view of a portion of a control panel of an aircraft showing push-pull circuit breakers constructed in accordance with this invention.
Figure 2:
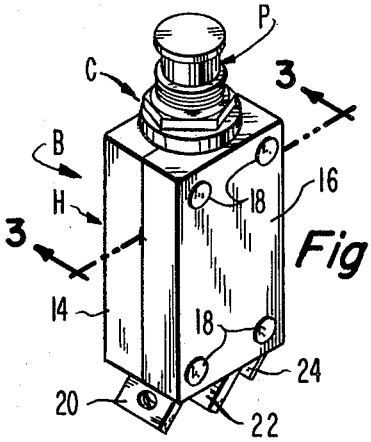
FIG. 2 is an enlarged perspective view of a push-pull circuit breaker constructed in accordance with this invention.

In accordance with this invention, a plurality of lighted circuit breakers B are shown in FIG. 1 mounted on aircraft control panel 10 of aircraft 12. Conveniently, the head of each plunger is marked with a numeral indicating the maximum amperage of the circuit and the circuit breaker for a two amp circuit is shown in the extended or open condition indicating that this circuit is malfunctioning. The complete circuit breaker, as best seen in FIG. 2, includes a plunger P extending through a collar C into a housing H which has first and second halves 14 and 16 interconnected by a plurality of screws or rivets 18. Extending from the end of the housing H opposite plunger P are first and second load leads 20 and 22, as well as a ground lead 24.

Figure 3:
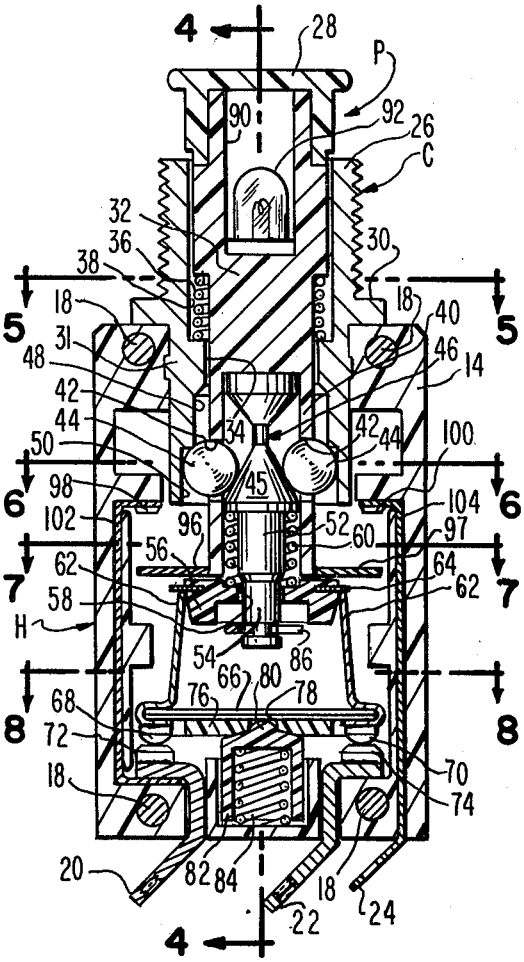
FIG. 3 is a grealy enlarged vertical section, taken along line 3—3 of FIG. 2 showing the internal construction of the circuit breaker with the components in the circuit-closing position.

Turning to FIG. 3, it can be seen that the plunger is slideably receivable in collar C which has an outwardly extending neck 26 from which the head 28 of the plunger extends and a peripheral flange 30 abutting the end of housing H, as well as a depending cylindrical support 31, held by housing halves 14 and 16. The plunger includes a body 32 extending through an internal bore 34 in collar C and is urged outwardly by a coil spring 36 positioned in a counterbore 38. The inner or interior end of plunger P is in the form of a sleeve 40 having a pair of oppositely spaced openings 42 through which locking balls 44 can pass to lock plunger P in a retracted position, as will be more fully described below. Advantageously, locking balls 44 bear against the conical surface 45 of spool 46 located within sleeve 40, as shown. Cylindrical support 31 of collar C has a first counterbore 48 and a second counterbore 50 against whose side walls locking balls 44 rest when the plunger is in retracted position. It will be noted that the conical surface 45 of spool 46 and the edge of counterbore 48 cause the locking balls 44 to engage the surfaces of second counterbore 50 so that the plunger cannot move upwardly under the influence of coilspring 36. A shaft 52 extends from the inner or lower end of spool 46 and has an end 54 of reduced cross section for slideably receiving lock support 56 which has a central aperture 58 receivable over the end 54 of shaft 52. Lock support 56 is normally urged inwardly by coil spring 60 surrounding shaft 52, and extending between lock support 56 and the inner end of spool 46, as shown. The lock support 56 is held in the raised position shown in FIG. 3, compressing spring 60, by a pair of support arms 62 which engage a peripheral flange 64 formed in lock support 56. The opposite end of the support arms are attached to the outer ends of bi-metal strip 66.

The bi-metal strip has contact 68 and 70 which respectively engage contact 72 of lead 20 and contact 74 of lead 22. Conveniently, the bi-metal strip is mounted on a support base 76 having a central opening 78 which receives a nib 80 on spring retaining cup 82. Within cup 82 is a coil spring 84 which tends to urge bi-metal strip 66 upwardly. However, it is held in the lower position shown in FIG. 4 by the pressure of support arms 62 engaging flange 64.

Figure 9:
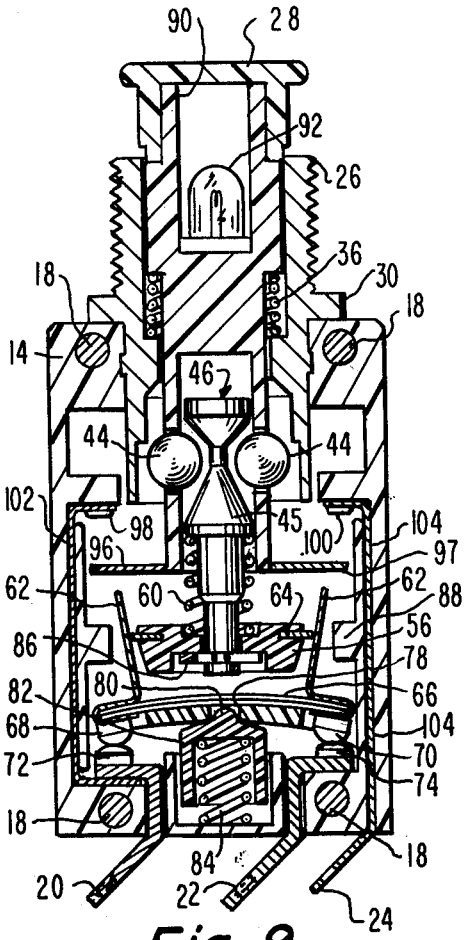
FIG. 9 is a vertical section of the push-pull circuit breaker of this invention, similar to FIG. 3, but showing the bi-metal strip curved into plunger-releasing position and showing the first releasing movement of the plunger locking mechanism prior to plunger extension.

When an overload condition occurs in the main circuit, the additional current will cause bi-metal strip 66 to bow as best seen in FIG. 9 until support arms 62 are moved outwardly so as to clear flange 64. Upon this occurance, spring 60 will force lock support 56 toward bi-metal strip 66 and against split ring stop 86. Also, spool 46 will move inwardly within sleeve 40 so that locking balls 44 can move toward the center.

Figure 10:
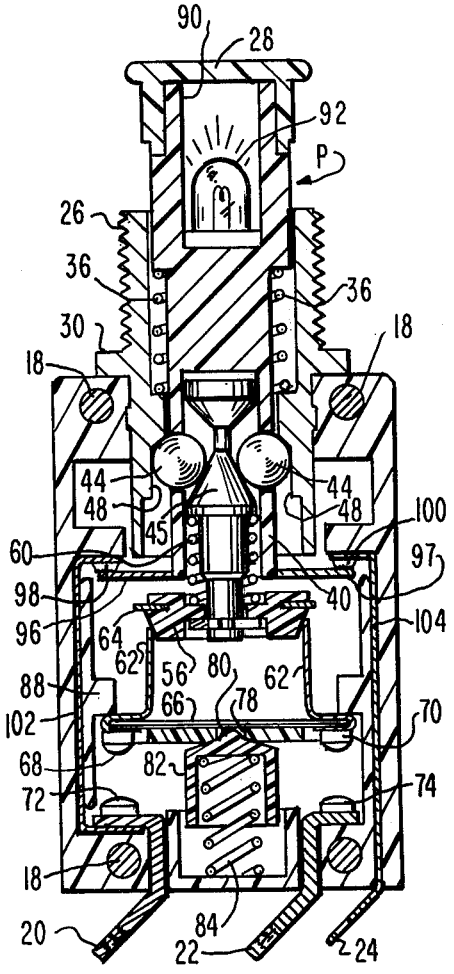
FIG. 10 is a vertical section, similar to FIGS. 3 and 9, but showing the plunger in extended position with the primary circuit broken and the secondary circuit to the light being completed.
Figure 6:
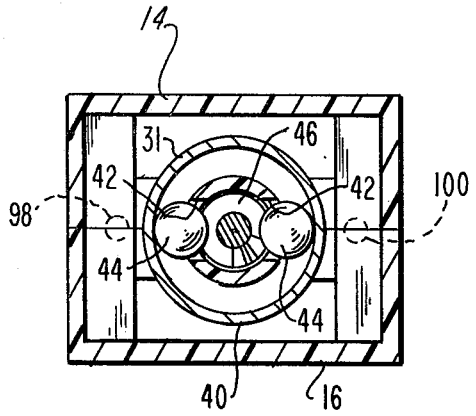
FIG. 6 is a horizontal section, taken along line 6—6 of FIG. 3, showing details of the plunger locking arrangement.
Figure 7:
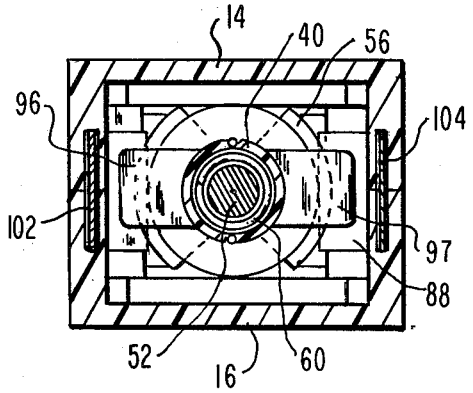
FIG. 7 is a horizontal section, taken along line 7—7 of FIG. 3, showing additional details of the plunger locking arrangement.
Figure 8:
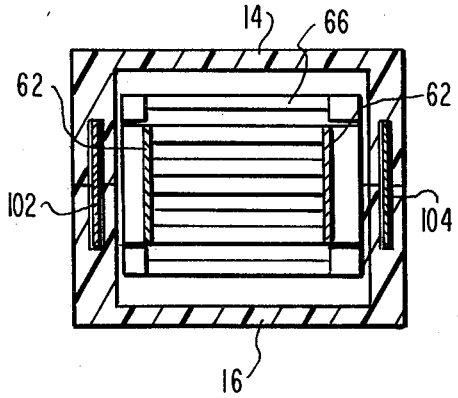
FIG. 8 is a horizontal section, taken along line 8—8 of FIG. 3, showing the bi-metal strip and circuit wire connection within the housing.

Thereupon, spring 36 forces plunger P outwardly until locking balls 44 strike the end of counterbore 48. The bi-metal strip will now be pushed upwardly against stop 88, conveniently molded in the housing, by spring 84 to break the circuit through leads 20 and 22, all as seen in FIG. 10.

Figure 4:
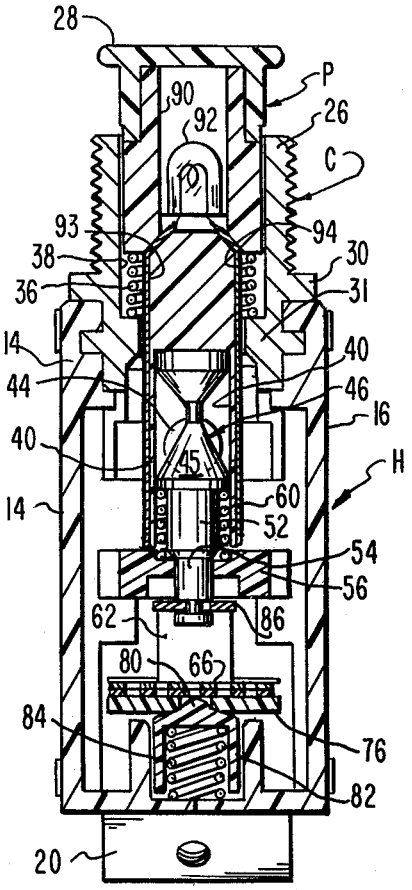
FIG. 4 is a vertical section, taken along line 4—4 of FIG. 3 showing further details of the circuit breaker of FIG. 3.
Figure 5:
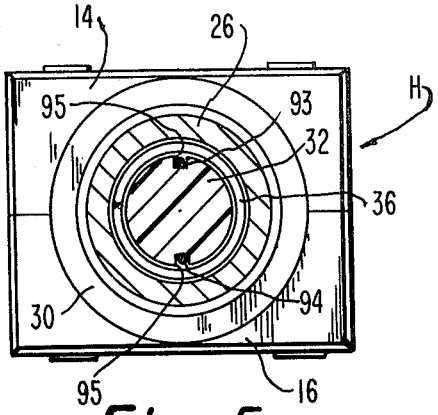
FIG. 5 is a horizontal section, taken along line 5—5 of FIG. 4 showing the positioning of the plunger extending spring and the leads from the light.

Advantageously, below cap 28 of the plunger is a recess 90 in which a light 92 is housed. As best seen in FIGS. 4 and 5, light 92 is connected by electrical lead 93 and 94 which extends along slots 95 in the body 35 of the plunger to electrical contact plates 96 and 97 respectively at the inner end of sleeve 40. These contact plates 96 and 97 engage contacts 98 and 100, respectively, which in turn are connected by wires 102 and 104 to lead 20 and ground lead 24, respectively, to complete the circuit to light 92 to signal a malfunction. Conveniently, either cap 28 or the upper portion of body 32 of plunger P may be made of transparent or translucent material so that the illumination from light 92 can be seen. Of course, once the problem has been corrected, the pilot can reset the circuit breaker by depressing plunger P until it resumes the closed position shown in FIG. 3, completing the main circuit and opening the circuit to light 92.

Figure 11:
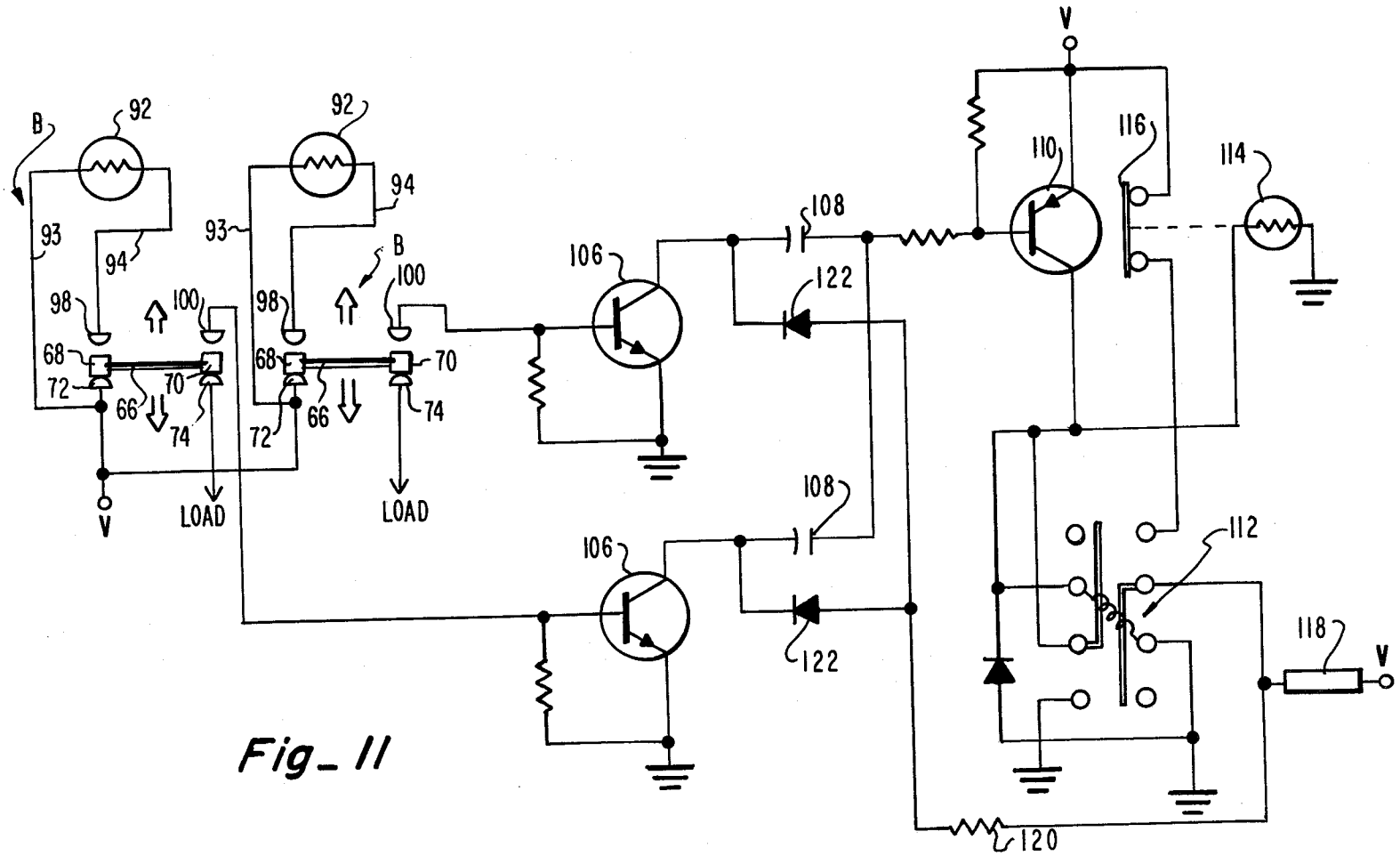
FIG. 11 is a circuit diagram showing two of the push-pull circuit breakers of this invention connected to a master caution lamp and an annunciator panel lamp.

Reference is now made to FIG. 11 which schematically illustrates the electric interconnection of two or more lighted circuit breakers B, each having a light 92. Although only two circuit breaker lights 92 are depicted, it is readily appreciated that any number can be interconnected. The circuit of FIG. 11 provides a visual indication to the aircraft operator that a fault or overload condition is present in at least one of the circuits monitored by the lighted circuit breakers B.

During normal or non-overload conditions, bi-metal strip 66 of each lighted circuit breaker B electrically couples voltage V to its monitored circuit load. When an overload condition occurs on one of these circuits, the bi-metal strip 66 associated therewith breaks contact between voltage V and the load and establishes a circuit path through a light 92. One side of the light 92 is then tied to the voltage V while the other side is joined to the base of a transistor 106. The transistor 106 is turned on and capacitor 108 charges sufficiently to turn on transistor 110. The voltage V then energizes the relay 112 and master caution lamp 114 is then lit by the application of the voltage V thereto. Master caution lamp 114 is positioned to be readily visible to the aircraft operator and, when lit, indicates that an overload condition is present in one of the circuits and that the lighted circuit breakers B should be checked to determine which circuit is experiencing difficulty. Once master caution lamp 114 is lit, master caution switch 116 can be momentarily switched by the operator from its normally closed position to its opened position. This activation opens the circuit path provided by the energization of the relay 112 thereby removing the voltage V applied to the master caution lamp 114 so that the master caution lamp 114 is no longer in its lighted condition.

At the same time master caution lamp 114 is lit indicating a fault in one of the aircraft circuits, annunciator lamp 118 is also lit. Annunciator lamp 118 is located on the aircraft annunciator panel and can be easily seen by the operator. Annunciator lamp 118 is energized or lit by the voltage V and a current path through the annunciator lamp 118 to ground is provided when the relay 112 is energized. Simultaneously with the momentary opening of master caution switch 116, the annunciator lamp 118 utilizes an alternative path to ground through dimming resistor 120 and the diode 122 which is associated with the light 92 then lit by the fault condition. This circuit path permits the annunciator lamp 118 to remain lit, but in a dimmed condition. This state indicates to the operator that a fault is present in the aircraft circuits, but also allows for the possibility of a second fault to be indicated if it should occur while the first fault is still present. The occurence of a second fault would light the master caution lamp 114 and return the annunciator lamp 118 to its bright light state. As a consequence, the operator can be made aware of the presence of additional circuit faults after the occurance of a first fault.

From the foregoing, the advantages of this invention are readily apparent. A circuit breaker has been provided for use in the control panel of an aircraft which becomes illuminated upon heating of a bi-metal strip due to overloading of the circuit associated with the circuit breaker so that a plunger is extended and a light therein is illuminated to immediately attract the pilot's attention or that of other personnel within the cockpit of the aircraft. Furthermore, a novel circuit breaker has been provided which can be used with a master caution lamp and with an annunciator panel lamp for easy visibility by the aircraft operator.

The invention has been described in detail with particular reference to a preferred embodiment thereof, but it will be understood that variations and modifications can be effected within the spirit and scope of the invention.

I claim:

1. A push-pull circuit breaker for use in the control panel of an aircraft wherein the plunger of the circuit breaker becomes illuminated upon opening of the circuit, said circuit breaker comprising:

a housing;

a plunger longitudinally slideable within one end of the housing between an extended position and a retracted position, said plunger having a translucent first end which projects from said housing and a second end extending within said housing;

locking means within said housing for releasably holding said plunger in said retracted position;

a light within said first end of said plunger;

a pair of power leads extending from said housing;

a ground lead extending from said housing;

a first pair of spaced contacts within said housing electrically connected, respectively, to each of said power leads;

a bi-metal strip which is normally flat and extends across said first pair of contacts to close a power circuit through said circuit breaker, but which becomes bowed upon overheating due to an overload in the circuit;

a second pair of spaced contacts within said housing, one of said second contacts being electrically connected to one of said first contacts and the other of said second contacts being electrically connected to said ground lead;

support arms extending between said bi-metal strip and said locking means for holding said locking means in releasably locked condition during normal operation of said circuit and being moved to a released position upon overloading of the circuit by said bi-metal strip when said bi-metal strip becomes bowed;

first spring means urging said plunger from said retracted position to said extended position upon release by said support arms; and a pair of separate contact plates mounted on said second end of said plunger connected to opposite sides of said light and each moved into electrical contact with one of said second pair of spaced contacts upon movement of said plunger from said retracted position to said extended position to illuminate said light.

2. A push-pull circuit breaker, as claimed in claim 1, wherein said locking means further includes:

a hollow sleeve formed on the inner end of said plunger and have opposed circular openings in the side wall thereof;

a locking ball positioned within each of said circular openings;

a spool-shaped element slideably mounted in said sleeve and having a cam surface engaging said locking balls and tending to urge them outwardly;

a pin depending from said spool-shaped element;

a locking base slideably mounted on the lower end of said pin;

second spring means within said hollow sleeve and surrounding the lower end of said pin biasing said spool against said balls to urge said balls into locked position and biasing said locking base against said support arms; and a flange extending from said locking base for engagement with said support arms when said plunger is in retracted position.

3. A push-pull circuit breaker, as claimed in claim 1, further including:

a third spring mounted between said housing and said bi-metal strip tending to urge such bi-metal strip away from said first set of contacts.

* * * * *